US007131292B2

(12) United States Patent
Ikegami et al.

(10) Patent No.: US 7,131,292 B2
(45) Date of Patent: Nov. 7, 2006

(54) GAS-LIQUID SEPARATOR

(75) Inventors: Makoto Ikegami, Anjou (JP); Haruyuki Nishijima, Oobu (JP); Hirotsugu Takeuchi, Nagoya (JP); Hisatsugu Matsunaga, Anjou (JP); Toru Ikemoto, Chiryu (JP)

(73) Assignee: DENSO Corporation, Kariya (JP)

( * ) Notice: Subject to any disclaimer, the term of this patent is extended or adjusted under 35 U.S.C. 154(b) by 10 days.

(21) Appl. No.: 11/055,381

(22) Filed: Feb. 10, 2005

(65) Prior Publication Data

US 2005/0178149 A1 Aug. 18, 2005

(30) Foreign Application Priority Data

Feb. 18, 2004 (JP) ..... 2004-041161
Mar. 22, 2004 (JP) ..... 2004-082945

(51) Int. Cl.
*F25B 1/06* (2006.01)

(52) U.S. Cl. ..... 62/500

(58) Field of Classification Search ..... 62/500, 62/512

See application file for complete search history.

(56) References Cited

U.S. PATENT DOCUMENTS

| | | | |
|---|---|---|---|
| 6,477,857 | B1 | 11/2002 | Takeuchi et al. |
| 6,574,987 | B1 | 6/2003 | Takeuchi et al. |
| 6,742,356 | B1 | 6/2004 | Saito et al. |
| 2001/0025499 | A1 | 10/2001 | Takeuchi et al. |
| 2002/0184903 | A1 | 12/2002 | Takeuchi et al. |
| 2003/0126883 | A1 | 7/2003 | Saito et al. |

FOREIGN PATENT DOCUMENTS

| | | |
|---|---|---|
| JP | 2002-349978 | 12/2002 |
| JP | 2003-202168 | 7/2003 |

*Primary Examiner*—Melvin Jones
(74) *Attorney, Agent, or Firm*—Harness, Dickey & Pierce, PLC

(57) ABSTRACT

A fluid in the state of two phase containing gas and liquid, which flows into the separating space, is revolved along an inner wall of the separating space and a liquid flow outlet is opened toward a revolving flow of the fluid and arranged in a lower portion of the separating space. The liquid-phase fluid which is a part of the revolving flow of the fluid flows out through the liquid flow outlet.

13 Claims, 7 Drawing Sheets

VIEW TAKEN IN THE DIRECTION OF A

GAS-LIQUID SEPARATOR

BACKGROUND OF THE INVENTION

1. Field of the Invention

The present invention relates to a gas-liquid separator for separating a fluid, in the state of two phases, and which contains a gas-phase fluid and a liquid-phase fluid, into a gas-phase fluid and a liquid-phase fluid. This gas-liquid separator is effective when it is applied to an ejector cycle.

2. Description of the Related Art

Conventional gas-liquid separators for separating a refrigerant in the state of two phases, which contains a gas-phase refrigerant and a liquid-phase refrigerant, into a gas-phase refrigerant and a liquid-phase refrigerant and storing a surplus refrigerant are disclosed in Japanese Patent Publication No. 2002-349978, which will be referred to as Conventional Example 1 hereinafter, and Japanese Patent Publication No. 2003-202168 which will be referred to as Conventional Example 2 hereinafter. In the gas-liquid separators 50, 52 of Conventional Examples 1 and 2 shown in FIGS. 10 and 11, the liquid flow outlet 19*a*, from which a refrigerant of the liquid phase flows out, is arranged in the lowermost portion of the separation space 18 and opens upward when each gas-liquid separator 50, 52 is normally installed. In this connection, reference numeral 51 defines a flow-out pipe 51 of oil supplied to a compressor.

Due to the above structure, it is possible for the liquid refrigerant to flow out from the lowermost portion of the separating space 18 in which the liquid refrigerant is stored.

However, in Conventional Examples 1 and 2, after the velocity energy of the liquid refrigerant has become zero in the separating space 18, the liquid refrigerant flows out from the separating space 18 by the weight (potential energy) of the refrigerant itself and the suction energy of a refrigerant conveyance means (for example, an ejector) arranged in the downstream of the liquid flow outlet 19*a*. Therefore, the flow-out velocity is decreased, and the refrigerant stays in the downstream of the liquid flow outlet 19*a* in the worst case.

SUMMARY OF THE INVENTION

In view of the above points of the prior art, it is an object of the present invention to prevent a decrease in the flow-out velocity of the refrigerant flowing out from a gas-liquid separator. In other words, it is an object of the present invention to reduce a loss of velocity energy of the refrigerant in the gas-liquid separator.

In order to accomplish the above object, according to a first aspect of the present invention, there is provided a gas-liquid separator comprising: a separating space (18), from the inlet (17*a*) of which a fluid in the state of two phases containing gas and liquid flows into the separating space (18), the fluid being separated into a liquid-phase fluid and a gas-phase fluid in the separating space (18); a gas flow outlet (20*a*) through which the gas-phase fluid flows out from the separating space (18); and a liquid flow outlet (19*a*) through which the liquid-phase fluid flows out from the separating space (18), wherein the fluid in the state of two phase containing gas and liquid is revolved in the separating space (18), and the liquid flow outlet (19*a*) is arranged in a lower portion of the separating space (18) being opened toward a revolving flow (S) of the fluid.

Due to the foregoing, a fluid in the state of two phases, which contains a gas-phase fluid and a liquid-phase fluid, revolves in the separating space (18). Therefore, the liquid-phase fluid staying in the lower portion of the separating space (18) revolves together with the fluid in the state of two phases which contains a gas-phase fluid and a liquid-phase fluid. Further, as the liquid flow outlet (19*a*) is arranged so that it can be open toward the revolving flow (S) of the fluid, the fluid in the liquid phase can be made to flow out from the liquid flow outlet (19*a*) without causing any loss of velocity energy. Accordingly, it is possible to prevent a decrease in the flow-out velocity of the liquid-phase fluid flowing out from the liquid flow outlet (19*a*), that is, it is possible to reduce a loss of velocity energy of the fluid in the gas-liquid separator. Due to the foregoing, it is possible to prevent the fluid from staying downstream of the liquid flow outlet (19*a*).

According to a second aspect of the present invention, an ejector cycle in which the first aspect of the gas-liquid separator is used, comprises: a compressor (11) for sucking and compressing the gas-phase fluid; a radiator (12) for radiating heat of the gas-phase fluid discharged from the compressor (11); an evaporator (16) for exhibiting a heat absorbing function by evaporating the liquid-phase fluid; and an ejector (13), which is a decompressing means for decompressing and expanding the gas-phase fluid of high pressure flowing out from the radiator (12) and, at the same time, is a momentum transfer type pump for sucking and conveying the fluid, which has been evaporated by the evaporator (16), by the entrainment action of the hydraulic fluid jetted out at high speed, wherein the fluid, which has flowed out from the ejector (13), flows into the inlet (17*a*).

Due to the foregoing, the fluid flowing out from the ejector (13), that is, the fluid in the state of two phases, which contains a gas-phase fluid and a liquid-phase fluid, flows into the separating space (18) and is then separated into a liquid-phase fluid and a gas-phase fluid in the separating space (18). After that, under the condition that a loss of velocity energy of the fluid flowing into the separating space (18) is reduced, the liquid fluid can be made to flow into the evaporator (16) from the liquid flow outlet (19*a*). Therefore, the velocity of the liquid fluid flowing into the evaporator (16) is increased, and the fluid can be prevented from staying in the evaporator (16). Further, as the amount of the fluid flowing into the evaporator (16) is increased, the evaporator (16) can exhibit a stronger heat absorbing action. Accordingly, the refrigerating efficiency of the ejector cycle can be enhanced.

In this connection, in the case where the gas-liquid separators described in Conventional Examples 1 and 2 are applied to the ejector cycle, it is necessary that the velocity energy of the liquid-phase fluid, which has become zero in the gas-liquid separators, must be raised again by the compression and suction of the fluid conducted by the compressor (11). However, as the gas-liquid separator of the first aspect is used in the ejector cycle of the second aspect, a loss of the velocity energy of the fluid caused in the gas-liquid separator is small. That is, as a compressing and sucking action of the fluid conducted by the compressor (11) can be reduced, the energy efficiency of the entire ejector cycle can be enhanced.

As a third aspect of the present invention, in the second aspect of an ejector cycle, the density ratio of the fluid, which is a value obtained when the liquid phase density is divided by the gas phase density, may be high.

As a fourth aspect of the present invention, in the third aspect of an ejector cycle, the fluid, the density ratio of which is high, may be one of refrigerant R404A, HC, R134a, R410A and R407C.

As a fifth aspect of the present invention, in the first aspect of a gas-liquid separator, the gas-liquid separator further comprises a tapering shape by which a sectional area of the separating space is gradually reduced when it is directed toward the liquid flow outlet, wherein a size of the separating space in the perpendicular direction is larger than a size of the separating space in the horizontal direction.

In this case a comparison is made, as follows, on the assumption that the quantities of the liquid accommodated in the separating spaces are the same. As the separating space is formed into the tapering shape (18*b*), a sectional area of the separating space (18) is reduced when it comes toward the liquid flow outlet (19*a*). Therefore, compared with a case in which the tapering shape (18*b*) is not formed, it is possible to increase a level of the fluid. Further, as the size (H) in the perpendicular direction of the separating space (18) is larger than the size (W) in the horizontal direction, it is possible to increase a level of the liquid as compared with the case shown in the document of FIG. 11 in which the size (W) in the horizontal direction of the separating space (18) is larger than the size (H) in the perpendicular direction.

Due to the foregoing, as the level of the fluid at the liquid flow outlet (19*a*) can be raised, it is possible to prevent the fluid in the gas phase from flowing out from the liquid flow outlet (19*a*), that is, it is possible to enhance the gas-liquid separating performance of the gas-liquid separator.

As a sixth aspect of the present invention, in the second aspect of an ejector cycle, the gas-liquid separator includes at least two gas flow outlets, and one of the two gas flow outlets is arranged to open in the uppermost portion of the separating space.

Incidentally, the reference numerals in parentheses, to denote the above means, are intended to show the relationship of the specific means which will be described later in an embodiment of the invention.

The present invention may be more fully understood from the description of preferred embodiments of the invention set forth below, together with the accompanying drawings.

DESCRIPTION OF PREFERRED EMBODIMENTS

Figure 1:
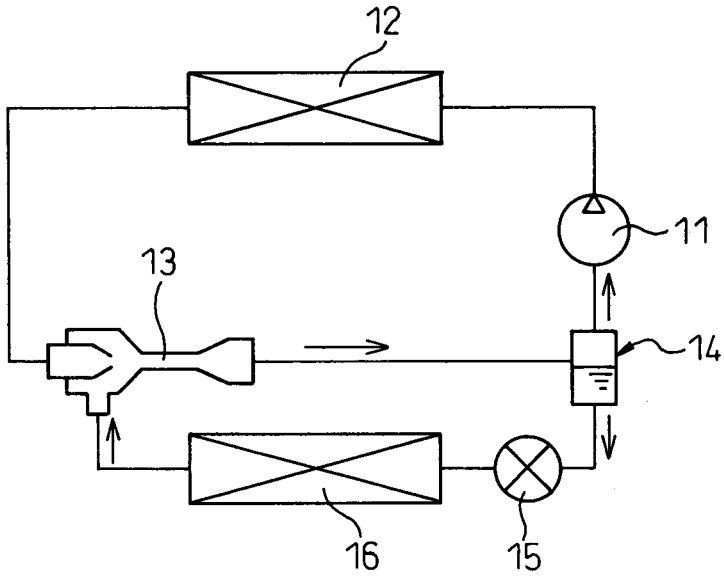
FIG. 1 is a view showing a model of the ejector cycle of the first embodiment in which a gas-liquid separator of the present invention is applied to an air conditioner for vehicle use.

First, the first embodiment of the present invention will be explained below. In this embodiment, the gas-liquid separator of the present invention is applied to an ejector (refrigerating) cycle of an air conditioner for vehicle use in which an ejector is used. FIG. 1 is a view showing a model of the ejector cycle of the embodiment. In FIG. 1, reference numeral 11 defines a compressor for sucking and compressing a refrigerant. A refrigerant compressed by the compressor 11 at high pressure flows into the radiator 12. Heat is radiated from the refrigerant to the outside air by the radiator 12. In other words, the refrigerant is cooled by the outside air.

The cooled refrigerant flows into the ejector 13. The ejector 13 functions as a refrigerant decompressing means and a refrigerant circulating means in the refrigerating cycle. Pressure energy of the refrigerant, which has flowed into the ejector 13, is converted into velocity energy by the nozzle section provided in the ejector 13. By the entrainment action of the hydraulic fluid jetted out from the nozzle at high speed, the gas-phase refrigerant, which has evaporated by the evaporator 16 described later, is sucked. Further, in the diffuser section, the refrigerant passage area of which is gradually extended, expansion energy of the refrigerant is converted into pressure energy, and the suction pressure of the compressor 11, which is arranged in the downstream of the refrigerant flow of the ejector 13, is raised.

The refrigerant, which has flowed out from the ejector 13, flows into the refrigerant flow passage 17 and further flows into the gas-liquid separator 14. At this time, the refrigerant flowing out from the ejector 13 is put into the two-phase state, in which gas and liquid are contained, by the decompressing action of the ejector 13. The gas-liquid separator 14 stores the refrigerant, which has flowed into it, under the condition that the gas-phase refrigerant and the liquid-phase refrigerant are separated from each other. The thus separated gas-phase refrigerant is sucked by the compressor 11 and compressed again. On the other hand, the thus separated liquid-phase refrigerant is sucked onto the evaporator 16 side. This gas-liquid separator 14 will be described later.

The evaporator 16 exhibits a refrigerating capacity when heat exchange is conducted between the liquid-phase refrigerant and the air blowing out into the vehicle room. In this connection, the first decompression device 15 arranged between the gas-liquid separator 14 and the evaporator 16 is a throttling means for reducing the pressure of the liquid-phase refrigerant sucked from the gas-liquid separator 14 to the evaporator 16 side. This first decompression device 15 positively reduces the pressure (evaporation pressure) in the evaporator 16.

In this connection, in the present embodiment, a fluid R404A, the density ratio of which is high, is used as a refrigerant. In this case, the density ratio is a value obtained when the liquid phase density is divided by the gas phase density. The gas phase density of R404A is approximately 42 kg/m$^3$, and the liquid phase density of R404A is approximately 1134 kg/m$^3$.

Figure 2:
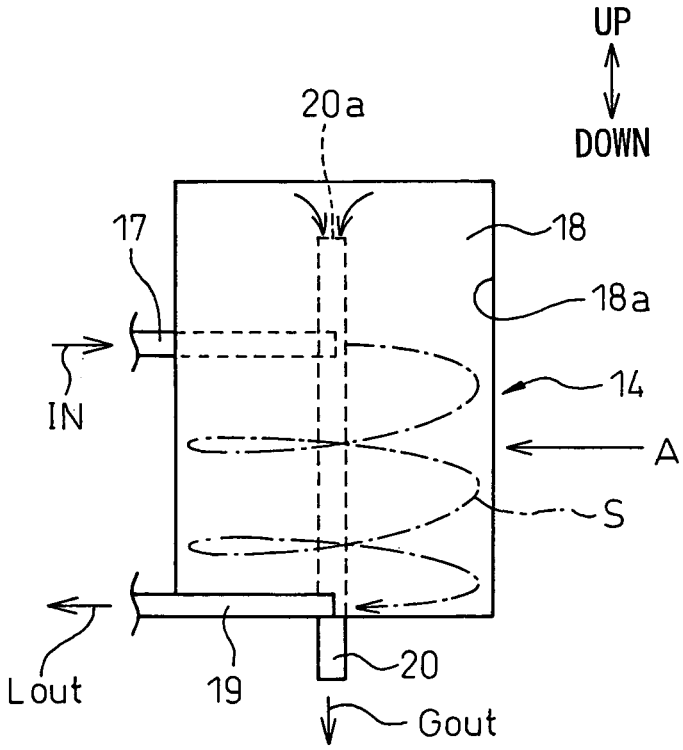
FIG. 2 is a side view showing a gas-liquid separator of the first embodiment.
Figure 3:
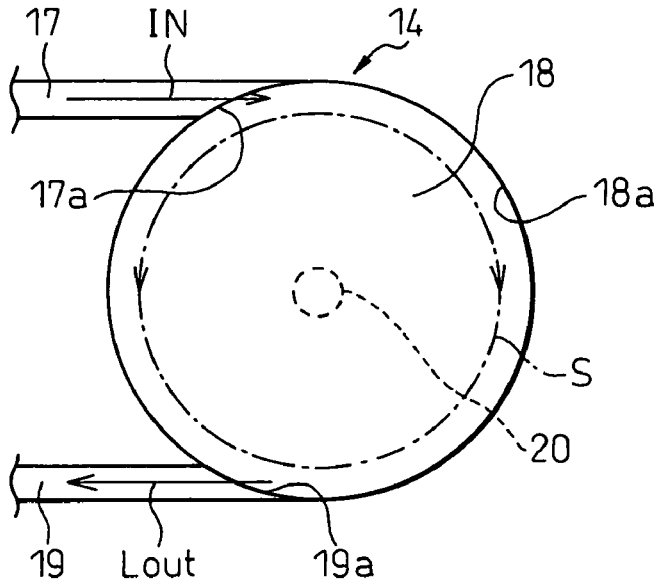
FIG. 3 is a plan view showing a gas-liquid separator of the first embodiment.

Next, referring to the side view of FIG. 2 and the plan view of FIG. 3, the gas-liquid separator 14 will be explained in detail as follows. The gas-liquid separator 14 includes a substantially cylindrical separating space 18. In this separating space 18, the inlet 17*a* of the flow passage 17 is arranged, into which the refrigerant in the state of two phases containing gas and liquid flows from the ejector 13 as shown by arrow IN in the drawing. The inlet 17*a* is arranged at a position somewhat on the upper side of the middle portion of the separating space 18 in the vertical direction. Further, the inlet 17*a* is open so that a flow of the two-phase refrigerant flowing into the separating space 18 can be directed in the outer circumferential tangential direction of the separating space 18 when it is viewed in the plan view (FIG. 3). In this connection, the arrow of up and down shown in the drawing indicates the direction of up and down of the gas-liquid separator 14 when it is installed.

The two-phase refrigerant flow IN, which has flowed into the separating space 18, is changed into flow S revolving in the separating space 18 when it collides with the inner wall 18*a* forming the separating space 18. The density of the liquid-phase refrigerant contained in the two-phase refrigerant is so high that it drops downward in the drawing by the action of gravity as shown by arrow S in FIG. 2 and stays on the lower side of the separating space 18. On the other hand, density of the gas-phase refrigerant is so low that it stays on the upper side of the separating space 18.

In the lowermost portion of the separating space 18, the liquid flow-out pipe 19 from which the liquid-phase refrigerant flows out is arranged. This liquid flow-out pipe 19 includes a liquid flow outlet 19*a* which is directed toward revolving flow S described later. In other words, the tangential direction of revolving flow S in the plan view (FIG. 3) coincides with the direction of the liquid refrigerant flow $L_{out}$ flowing out from the liquid flow outlet 19*a* via the liquid flow passage 19. In this connection, the liquid flow outlet 19*a* is arranged so that the liquid refrigerant flow $L_{out}$ flowing out from the separating space 18 can coincide with the outer circumferential tangential direction of the separating space 18.

On the other hand, the separated gas-phase refrigerant flows out from the gas flow-out pipe 20. The gas flow outlet 20*a* of this gas flow-out pipe 20 is located at a position higher than the inlet 17*a* in the separating space 18. Due to the foregoing, only the gas refrigerant staying on the upper side of the separating space 18 can be made to flow out without making the liquid-phase refrigerant contained in the two phase flow, which flows into the separating space 18, flow out.

Next, the operational effects of the first embodiment will be enumerated as follows.

(1) As the liquid flow outlet 19*a* is open toward revolving flow S, the liquid-phase refrigerant can be made to flow out from the liquid flow outlet 19*a* without causing a loss of velocity energy.

In more detail, a two-phase refrigerant flowing into the separating space 18 becomes a revolving flow along the inner wall 18*a*, and the liquid-phase refrigerant staying in a lower portion of the separating space 18 also revolves along the inner wall 18*a*. As the liquid flow outlet 19*a* is open so that the tangential direction of revolving flow S in the plan view (FIG. 3) can coincide with the direction of the liquid refrigerant flow $L_{out}$ flowing out from the liquid flow outlet 19*a*, the liquid-phase refrigerant flows out from the liquid flow outlet 19*a* without causing a loss of velocity energy.

Due to the foregoing, a loss of kinetic energy of the refrigerant flowing into the gas-liquid separator 14 can be reduced. That is, a velocity of the liquid refrigerant flowing into the evaporator 16, which is arranged in the downstream of the liquid flow-out pipe 19, can be raised. Due to the foregoing, a quantity of the refrigerant flowing into the evaporator 16 can be increased. Accordingly, the heat exchange efficiency of the evaporator 16 can be enhanced and the refrigerating capacity can be enhanced. According to the evaluation made by the present inventors, the following advantage was confirmed. In the refrigerating machine in which R404A was used as the refrigerant, the refrigerating capacity was enhanced by 60% when the structure of the present embodiment was adopted.

Further, when a velocity of the liquid refrigerant flowing into the evaporator 16 is increased, the refrigerant velocity in the evaporator 16 is also increased. Therefore, an accumulation of the refrigerant in the evaporator 16 can be reduced and an accumulation of oil contained in the refrigerant can be also reduced. According to the evaluation made by the present inventors, the following advantage was confirmed. In the refrigerating machine in which R404A was used as the refrigerant, a quantity of the necessary refrigerant could be reduced by 30% while providing the same refrigerating capacity.

Figure 10:
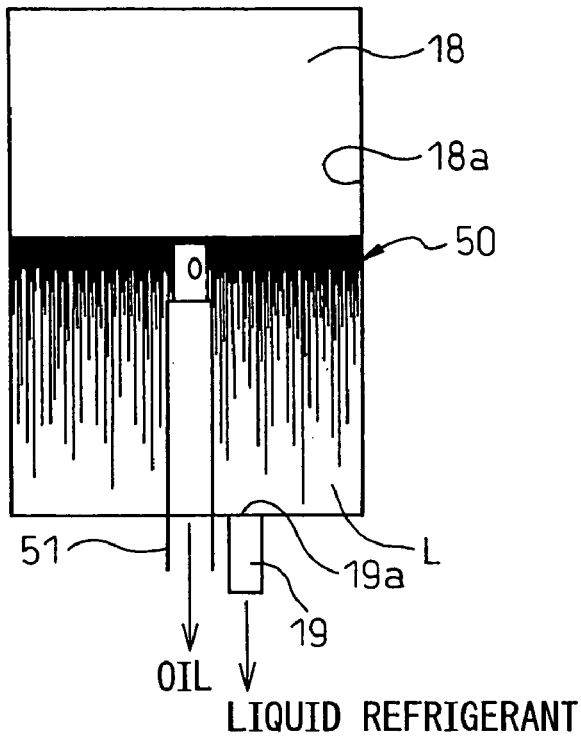
FIG. 10 is a side view showing a gas-liquid separator of Conventional Example 1.
Figure 11:
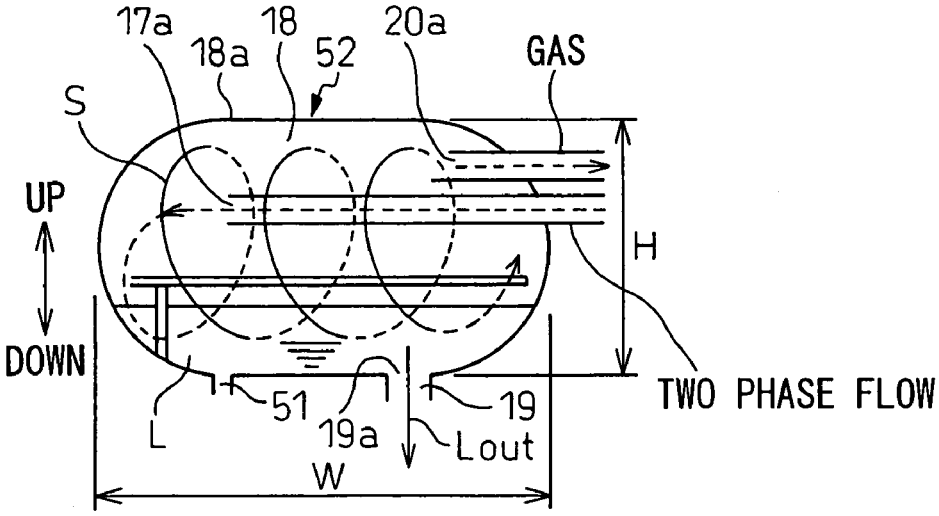
FIG. 11 is a side view showing a gas-liquid separator of Conventional Example 2.

In this connection, in the case where the gas-liquid separators 50, 52 of Conventional Examples 1 and 2 (shown in FIGS. 10 and 11) are applied to an ejector cycle, the velocity energy of the liquid refrigerant, which has once become zero in the gas-liquid separators 50, 52, must be raised again by the compression and suction of the refrigerant conducted by the compressor 11. However, according to the present embodiment, a loss of the velocity energy of the refrigerant in the gas-liquid separator 14 is small, that is, a compressing and sucking action of compressing and sucking the refrigerant by the compressor 11 can be reduced. Therefore, the energy efficiency of the entire ejector cycle can be enhanced.

(2) The liquid flow outlet 19*a* is arranged at the lowermost portion of the separating space 18. Further, the liquid flow outlet 19*a* is arranged so that the liquid refrigerant flow $L_{out}$ flowing out from the separating space 18 can coincide with the outer circumferential tangential direction of the separating space 18. Therefore, a flow-out of the gas-phase refrigerant flowing out from the liquid flow outlet 19*a* can be reduced.

Figure 4:
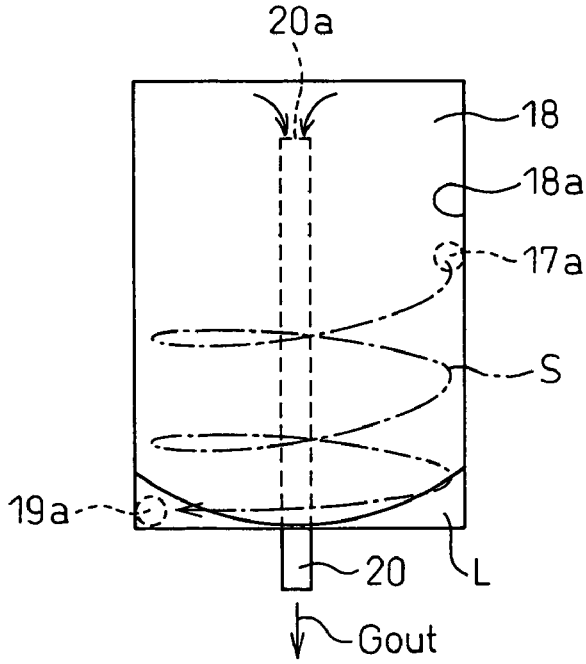
FIG. 4 is a view of the gas-liquid separator of FIG. 2, wherein the view is taken in the direction A.

In this connection, as importance has been recently attached to the environmental problems, a quantity of the refrigerant to be used is decreased to the necessary minimum. Accordingly, of course, a quantity of the refrigerant stored in the gas-liquid separator 14 is reduced. FIG. 4 is a view showing a state in which the amount of a liquid refrigerant L is small in the present embodiment. FIG. 2 is a view taken in the direction of arrow A in FIG. 2.

A flow of the two-phase refrigerant, which has flowed into the separating space 18 from the inlet 17*a*, is revolved in the separating space 18 as shown by arrow S when the flow collides with the inner wall 18*a* composing the separating space 18. At this time, the liquid-phase refrigerant L accumulated in a lower portion of the separating space 18 is also revolved. Accordingly, the level the liquid-phase refrigerant L is raised by a centrifugal force when the level comes close to the inner wall 18*a*. On the contrary, in the periphery of the center of the revolving flow S, the level of the liquid-phase refrigerant is lowered. The liquid flow outlet 19*a* of the present embodiment is arranged in the periphery of the inner wall 18*a* at which the level is raised to the highest position, that is, the liquid flow outlet 19*a* of the present embodiment is arranged at a position where the direction of the liquid refrigerant flow $L_{out}$ flowing out from the separating space 18 can be substantially the same as the direction of the outer circumferential tangent of the separating space 18. Therefore, even when the amount of the liquid refrigerant is decreased, it is possible to reduce the amount of the gas-phase refrigerant flowing out from the liquid flow outlet 19*a* by the high level of the liquid refrigerant.

In this connection, a difference of the level between the periphery 18*a* of the inner wall and the periphery of the center of the revolving flow S is extended in the case of a fluid, the density ratio of which is high. In this case, the density ratio is a value obtained when the liquid phase density is divided by the gas phase density. Therefore, in the case of the fluid, the density ratio of which is high, even when the amount of the fluid is small, it is possible to prevent the gas-phase refrigerant from flowing out from the liquid flow outlet 19*a*.

(3) In the plan view (FIG. 3), the inlet 17*a* is open so that the two-phase refrigerant flow IN flowing into the separating space 18 can coincide with the outer circumferential tangential direction of the separating space 18. Therefore, it is possible to make a larger revolving flow S. Accordingly, a loss of energy caused in the gas-liquid separator 14 can be reduced.

Figure 5:
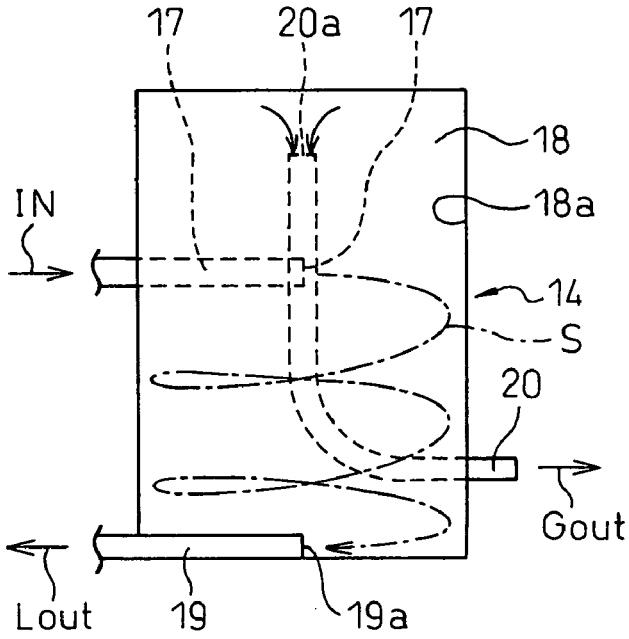
FIG. 5 is a side view showing a gas-liquid separator of the second embodiment.

Next, the second embodiment will be explained below. In the first embodiment, the gas flow-out pipe 20 is arranged in such a manner that the gas flow-out pipe 20 is taken out from the lower portion of the separating space 18 to the outside. However, in this embodiment, the gas flow-out pipe 20 is arranged in such a manner that the gas flow-out pipe 20 is taken out from the side of the separating space 18 to the outside as shown in FIG. 5. As long as the gas flow outlet 20*a* is open onto the side at a position located higher than the inlet 17*a*, the gas-phase refrigerant can be smoothly sucked. Therefore, even when the gas flow-out pipe 20 is taken out from the side of the separating space 18 as shown in this embodiment, the separating performance of the gas-liquid separator 14 is not affected.

Due to the foregoing, the degree of freedom of designing the arrangement of the gas flow-out pipe 20 can be enhanced.

Even in this embodiment, the operational effects described in items (1) to (3) of the first embodiment can be exhibited.

Figure 6:
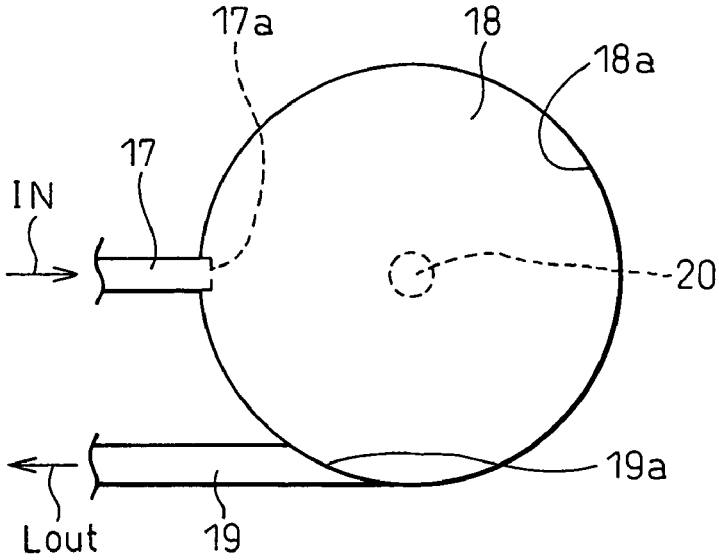
FIG. 6 is a side view showing a gas-liquid separator of the third embodiment.

Next, the third embodiment will be explained below. In the first and the second embodiment, in the plan view, the inlet 17*a* is open so that the two-phase refrigerant flow IN flowing into the separating space 18 can coincide with the outer circumferential tangential direction of the separating space 18. However, as shown in this embodiment, the inlet 17*a* may be arranged in such a manner that the inlet 17*a* is directed toward the center of the separating space 18 in the plan view (shown in FIG. 6).

Even in this arrangement, revolving flow S is generated by the inner wall 18*a* of the separating space 18. Accordingly, it is possible to exhibit the operational effects described in items (1) and (2) of the first embodiment.

Although the separating space has a cylindrical shape in the lower portion in the first to the third embodiment, a gas-liquid separator may comprise a tapering shape by which a sectional area of the separating space is gradually reduced toward the liquid flow outlet, wherein a size of the separating space in the perpendicular direction may be larger than a size of the separating space in the horizontal direction.

A comparison can be made, as follows, on the assumption that the quantities of the liquid accommodated in the separating spaces are the same. As the separating space is formed into the tapering shape, a sectional area of the separating space is reduced when it comes toward the liquid flow outlet. Therefore, compared with a case in which the tapering shape is not formed, it is possible to increase a level of the fluid. Further, as the size in the perpendicular direction of the separating space is larger than the size in the horizontal direction, it is possible to increase a level of the liquid as compared with the case shown in the document of FIG. 11 in which the size in the horizontal direction of the separating space is larger than the size in the perpendicular direction.

Due to the foregoing, as the level of the fluid-at the liquid flow outlet can be raised, it is possible to prevent the fluid in the gas phase from flowing out from the liquid flow outlet, that is, it is possible to enhance the gas-liquid separating performance of the gas-liquid separator.

Figure 7:
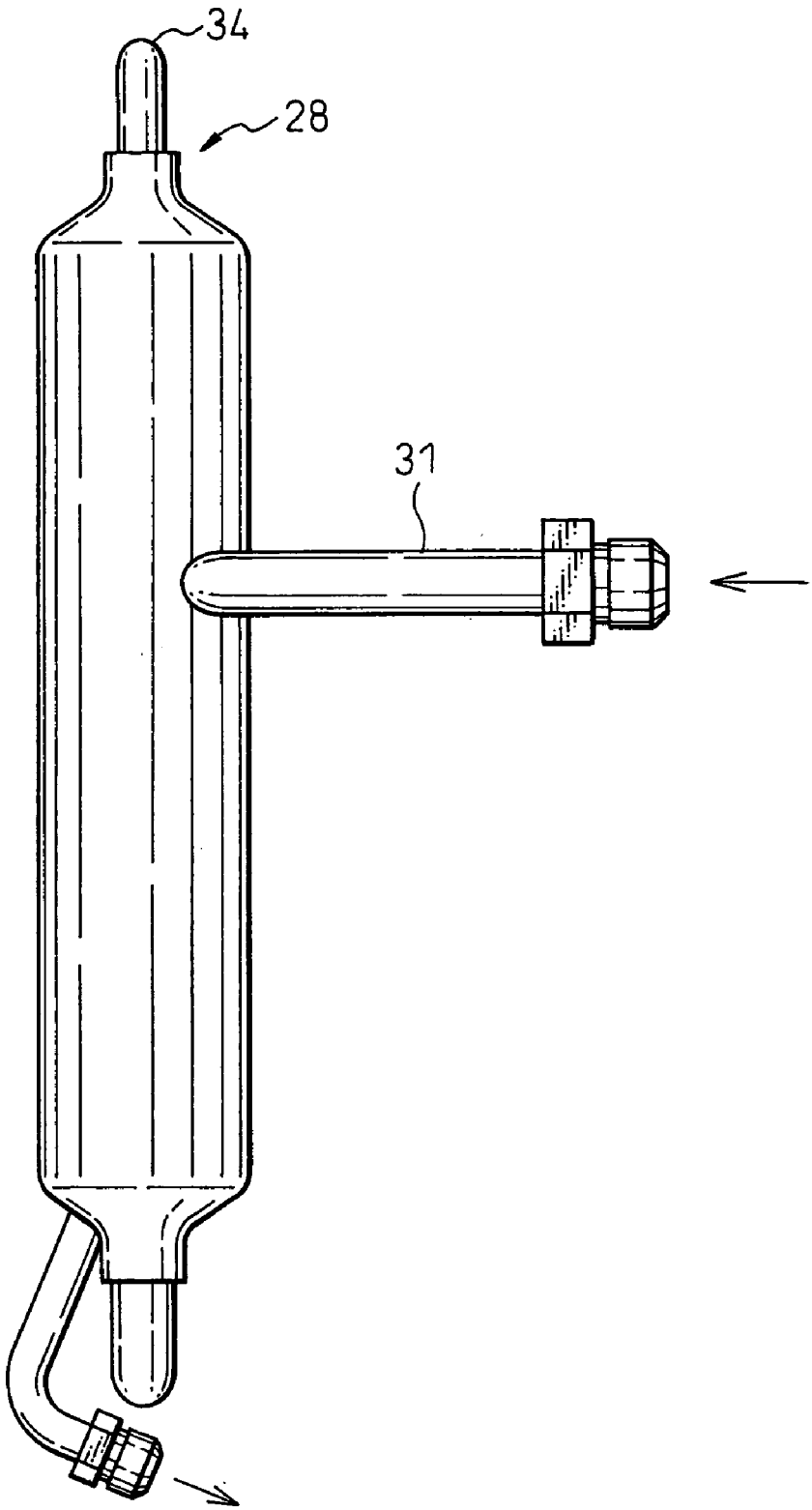
FIG. 7 is a front view showing a gas-liquid separator of the third embodiment.
Figure 8:
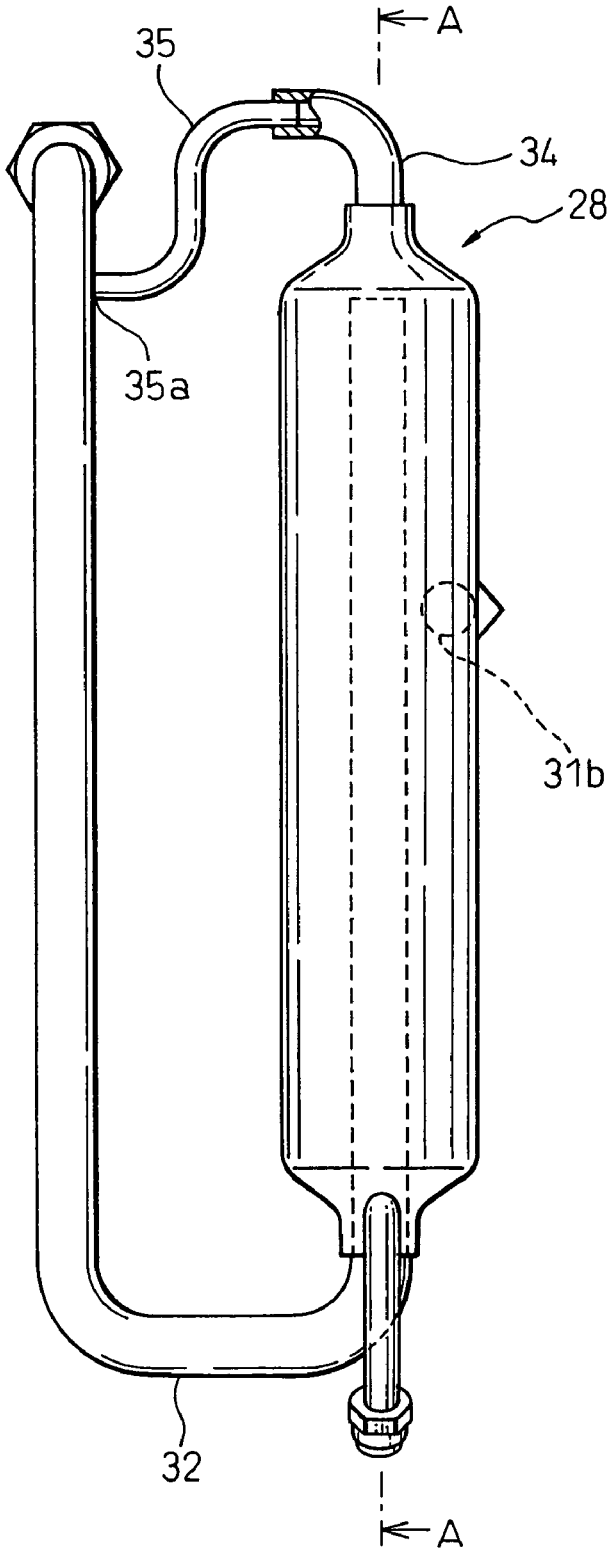
FIG. 8 is a side view showing a gas-liquid separator of the fourth embodiment.
Figure 9:
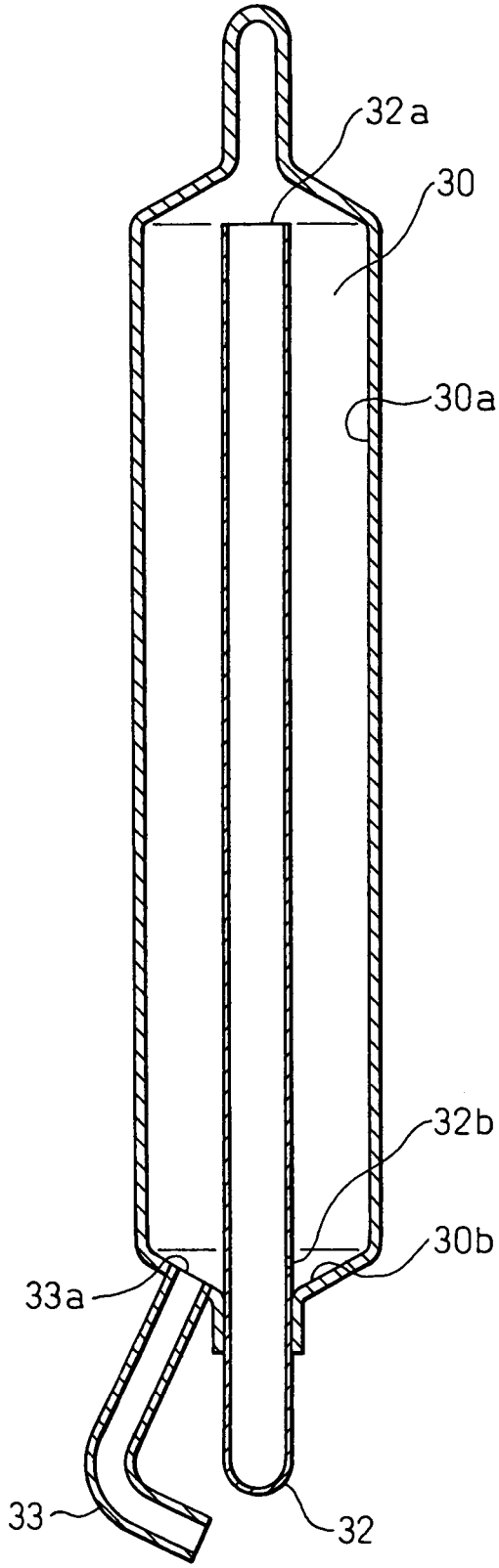
FIG. 9 is a sectional view taken on line A—A in FIG. 8.

Next, referring to FIGS. 7 to 9, the fourth embodiment will be explained below. This embodiment provides a gas-liquid separator applied to an air conditioner for vehicle use in which an ejector is used in the same manner as the first to the third embodiment.

The gas-liquid separator 28 includes a substantially cylindrical separating space 30 in which the refrigerant is separated into liquid and gas. The flow-in pipe 31, into which the refrigerant in the two-phase state containing gas and liquid which has flowed out from the ejector 13, is arranged so that the inlet 31*a* can be open into the separating space 30. The inlet 31*a* is open at a position somewhat higher than the middle of the separating space 30 in the vertical direction so that a flow of the two-phase refrigerant flowing into the separating space 30 can coincide with the outer circumferential tangential direction of the separating space 30.

The lowermost face 30*b* of the separating space 30 is formed into a conical shape which is tapered toward the central axis of the separating space 30. The liquid flow-out pipe 33 for discharging the liquid separated in the separating space is connected onto the lowermost face 30*b* in such a manner that the liquid flow-out pipe 33 can be substantially perpendicular to the inclined lowermost face, and the opening portion 33*a* is formed on the lowermost face 30*b*. The liquid flow-out pipe 33 is connected to the evaporator 16 so as to introduce the liquid refrigerant to the evaporator 16.

On the other hand, at the substantial axial center of the cylindrical separating space 30, the gas discharge pipe 32 for discharging gas is provided. The opening portion 32*a* of the gas discharge pipe 32 is open at a position close to the uppermost end of the separating space so that the liquid refrigerant cannot flow into the gas discharge pipe 32 even when the level of the liquid refrigerant accumulated in the separating space 30 rises to a considerable height. This gas discharge pipe 32 extends outside from the lower portion of-the separating space 40 as it is. As shown in FIG. 8, immediately after the gas discharge pipe 32 has been extended outside, it is bent by the angle 90° and further bent upward by the angle 90° and extended upward substantially in parallel with the longitudinal direction of the separating space 30. Then, the gas discharge pipe 32 is connected to the compressor 11. In a portion of the gas discharge pipe 32 in the periphery of the lowermost portion of the separating space 30, the oil sucking hole 32*b* is provided so that the oil accumulated in the lowermost portion of the separating space 30 can be guided into the gas discharge pipe 32.

Further, an upper portion of the separating space 30 is throttled toward the axial center. In the upper portion of the separating space 30, the second gas discharge pipe 34 is provided in the periphery of the axial center of the separating space 30 being extended upward. The second gas discharge pipe 34 is connected to the gas discharge pipe 32 via the connecting pipe 35. The second gas discharge pipe 34 is provided with the opening portion 35*a* which is open toward the gas discharge pipe 34. Concerning the diameters of the gas discharge pipe 32, the second gas discharge pipe 34 and the connecting pipe 35, the diameter of the gas discharge pipe 32 is the largest, and the diameter of the second gas discharge pipe 34 is the second largest. The diameter of the connecting pipe 35 is the smallest.

Due to the above structure, the gas refrigerant can be discharged from the separating space 18 toward the compressor 11 mainly via the gas discharge pipe. At the same time, the gas refrigerant can be discharged from the separating space 18 toward the compressor 11 via the second gas discharge pipe 34 in the upper portion.

Next, the operational effects of this gas-liquid separator 28 will be explained below.

The refrigerant in the two-phase state containing gas and liquid, which has flowed from the ejector 13, flows from the flow-in pipe 31 into the separating space 30 via the opening portion 31*b* open onto the cylindrical inner wall face 30*a*. As the opening portion 31*b* is open in the outer circumferential tangential direction which is shifted from the central axis of the separating space 30, the refrigerant flowing into the separating space 30 is revolved along the cylindrical inner wall face 30*a* of the separating space 30. Then, the refrigerant flows along the inner wall face 30*a* to the lower portion of the separating space 30 in such a manner that the refrigerant accumulates in the lower portion. Further, on the lowermost face 30*b* of the separating space 30, the refrigerant is revolved along the wall face of the lowermost face 30*b*. At this time, the revolving liquid refrigerant is given a component of the centrifugal force of the liquid refrigerant revolving in the direction perpendicular to the inclined face. On this inclined face 30*b*, the liquid flow-out pipe 33 is formed in such a manner that the liquid flow-out pipe 33 protrudes in the direction perpendicular to the inclined face 30*b*. Therefore, the liquid-phase refrigerant can flow out from the opening portion 33*a* by utilizing this component of centrifugal force without causing a loss of velocity energy. Further, as the lowermost face 30*b* is formed into a shape which is throttled toward the center of the separating space 30, even when the level of the refrigerant is remarkably lowered by a change in the capacity of the refrigerating cycle, the level can be ensured at a predetermined height.

On the other hand, the gas refrigerant separated in the upper portion of the separating space 30 is discharged from the opening portion 32*a* of the gas discharge pipe 32 and introduced to the compressor 11. In this case, as the oil sucking hole 32*b* for sucking oil is provided in the periphery of the lower portion of the separating space 30, the oil staying in the lower portion of the separating space 30 is sucked into the gas discharge pipe 32 by the sucking force of the gas refrigerant and introduced to the compressor together with the gas refrigerant so that the compressor can be lubricated.

Even when the capacity of the refrigerating cycle is lowered and the level of the liquid refrigerant in the separating space 30 is raised to the height of the opening portion of the discharge pipe 32 and the gas discharge pipe 32 is stopped up by the liquid refrigerant, in the worst case, the gas refrigerant can be introduced from the second gas discharge pipe 34, which is provided in an upper portion of the separating space 30, to the gas discharge pipe 32 via the connecting pipe 35*a*. Therefore, it is possible to prevent the liquid refrigerant from being discharged into the compressor 11.

When the gas-liquid separator 28 is composed as described above, as the lowermost face 30*a* is inclined and the liquid discharge pipe is arranged in the direction perpendicular to the inclined face, the liquid refrigerant can be made to flow to the evaporator 16 without causing a loss of the velocity energy of the liquid refrigerant. As the gas discharge pipes are provided in the upper and the lower portion, it is possible to ensure a high allowance height of the level of the liquid refrigerant in the separating space 30. Therefore, it is sufficient to ensure the minimum separating space 30 in which the liquid refrigerant is accumulated when the capacity of the refrigerating cycle is changed. Accordingly, the separating space 30 can be designed to be compact.

Finally, another embodiment will be explained below. The first to the fourth embodiment described above are examples in which R404A is used for the refrigerant. However, according to the present invention, the refrigerant is not limited to R404A. It is possible to use various refrigerants such as HC, R134a, R410A and R407C. The gas-liquid separator of the present invention is not limited to the use of a refrigerant. The gas-liquid separator of the present invention can be applied to a fluid in the two-phase state.

In the first to the fourth embodiment described above, the gas-liquid separator of the present invention is applied to the ejector cycle of an air conditioner for vehicle use. However, the present invention is not limited to the air conditioner for vehicle use. The present invention can be also applied to an ejector cycle used for the heat pump cycle for supplying hot water.

While the invention has been described by reference to specific embodiments chosen for purposes of illustration, it should be apparent that numerous modifications could be made thereto by those skilled in the art without departing from the basic concept and scope of the invention.

The invention claimed is:

1. A gas-liquid separator comprising:

a separating space having an inlet from which a fluid containing gas and liquid flows into the separating space, the fluid being separated into a liquid-phase fluid and a gas-phase fluid in the separating space;

a gas flow outlet through which the gas-phase fluid flows out from the separating space; and a liquid flow outlet through which the liquid-phase fluid flows out from the separating space, wherein the fluid containing the gas and liquid forms a revolving flow in the separating space, and the liquid flow outlet is arranged in a lower portion of the separating space being opened toward the revolving flow of the fluid.

2. An ejector cycle in which the gas-liquid separator according to claim 1 is used, comprising:

a compressor for sucking and compressing the gas-phase fluid;

a radiator for radiating heat of the gas-phase fluid discharged from the compressor;

an evaporator for exhibiting a heat absorbing function by evaporating the liquid-phase fluid; and an ejector, which is a decompressing means for decompressing and expanding the gas-phase fluid of high pressure flowing out from the radiator at the same time, which is a momentum transfer type pump for sucking and conveying the fluid, which has been evaporated by the evaporator, by the entrainment action of the fluid jetted out at high speed, wherein the fluid, which has flowed out from the ejector, flows into the inlet.

3. An ejector cycle according to claim 2, where in a density ratio, which is a value obtained when a liquid phase density is divided by a gas phase density, of the fluid is high.

4. An ejector cycle according to claim 3, wherein the fluid, the density ratio of which is high, is one of refrigerant R404A, HC, R134a, R410A and R407C.

5. A gas-liquid separator according to claim 1, further comprising a tapering shape by which a sectional area of the separating space is gradually reduced when it is directed toward the liquid flow outlet, wherein a size of the separating space in a vertical direction is larger than a size of the separating space in a horizontal direction.

6. An ejector cycle according to claim 2, wherein the gas-liquid separator includes at least two gas flow outlets, and one of the at least two gas flow outlets is arranged being open in the uppermost portion of the separating space.

7. The gas-liquid separator according to claim 1, wherein the separating space is formed by a cylindrical inner surface, the fluid containing the gas and liquid being directed against the cylindrical inner surface to form the revolving flow.

8. The gas-liquid separator according to claim 7, wherein the liquid flow outlet is disposed along a tangent line of the cylindrical inner surface.

9. The gas-liquid separator according to claim 8, wherein the inlet is disposed along a tangent line of the cylindrical inner surface.

10. The gas-liquid separator according to claim 7, wherein the inlet is disposed along a tangent line of the cylindrical inner surface.

11. The gas-liquid separator according to claim 5, wherein the liquid flow outlet is disposed generally perpendicular to the tapering shape.

12. The gas-liquid separator according to claim 11, wherein the inlet is disposed along a tangent line of the cylindrical inner surface.

13. The gas-liquid separator according to claim 1, wherein the revolving flow revolves around a generally vertical axis.

* * * * *